US006230906B1

(12) United States Patent
Padiak et al.

(10) Patent No.: US 6,230,906 B1
(45) Date of Patent: May 15, 2001

(54) PRODUCT DISPLAY RACK

(75) Inventors: Scott Padiak, Winnetka; Paul C. Evans, Chicago, both of IL (US)

(73) Assignee: Cormark, Inc., Elk Grove Village, IL (US)

( * ) Notice: Subject to any disclaimer, the term of this patent is extended or adjusted under 35 U.S.C. 154(b) by 0 days.

(21) Appl. No.: 09/549,247

(22) Filed: Apr. 14, 2000

(51) Int. Cl.[7] ..... A47F 5/00

(52) U.S. Cl. ..... 211/85.18; 211/59.2; 211/194; 312/45; 312/72

(58) Field of Search ..... 211/59.2, 85.3, 211/126.2, 133.1, 194, 129.1, 131.1, 85.18; 312/45, 72, 73

(56) References Cited

U.S. PATENT DOCUMENTS 310,784 * 1/1885 Bollinger .
3,126,101 * 3/1964 Katterjohn .
3,304,141 * 2/1967 Rogers .
4,216,867 * 8/1980 Sturm .
4,336,886 * 6/1982 Azoulay et al. .
4,822,118 * 4/1989 Watkins .
4,946,048 * 8/1990 Francois .
4,964,520 * 10/1990 Kilmartin .
5,743,412 * 4/1998 Noble ..... 211/59.2
5,816,419 * 10/1998 Lawson ..... 211/59.2 X
5,865,324 * 2/1999 Jay et al. ..... 211/59.2
6,068,139 * 5/2000 Brozak ..... 211/59.2
6,095,347 * 8/2000 Mauro-Vetter ..... 211/59.2 X

* cited by examiner

*Primary Examiner*—Robert W. Gibson, Jr.
(74) *Attorney, Agent, or Firm*—Welsh & Katz, Ltd.

(57) ABSTRACT

A display rack for displaying and dispensing cylindrically-shaped products. The display rack includes a first storage region and a second storage region. The first storage region is capable of holding a plurality of cylindrically-shaped products. The first storage region has a first dispensing position. The first storage region is tilted towards the first dispensing position. The second storage region surface is capable of holding a plurality of cylindrically-shaped products. The second storage region has a second dispensing position. The second storage region is adjacent to the first storage region. The first storage region and the second storage region tilt away from each other. The second storage region is tilted towards the second dispensing position.

18 Claims, 2 Drawing Sheets

PRODUCT DISPLAY RACK

FIELD OF THE INVENTION

This invention pertains to a product display rack. More particularly, the invention pertains to a product display rack that maintains the product in a faced orientation.

BACKGROUND OF THE INVENTION

It is becoming increasingly more expensive to operate retail stores. Next to the cost of the products being sold, two of the most important factors associated with the cost of operating a retail store are rent and employee costs.

To compensate for increases in rent, retail stores seek to display greater amounts of product in a given area. This desire is often accomplished by adding more product display shelves. A limitation on adding shelves is the ability of the customer to readily select products from the shelves.

To more efficiently utilize the employee resources, retail stores desire to place larger numbers of a given product on the shelves at a specified time. This technique reduces the frequency at which the shelves must be restocked with more products.

Since there is only a limited amount of shelving space in a retail store, it can be appreciated that there is a trade-off between stocking the shelves with larger amounts of a smaller selection of products or with a larger number of products with only a relatively small number of each product.

With certain types of products, customers are confronted with a large variety of products that are reviewed when selecting a particular product to purchase. One particular product with which customers are often provided with a large selections of purchase options is paint.

To assist customers to easily identify the color of paint contained in a spray paint can, the cap of the spray paint can is typically formed with a color that approximates the color of the paint in the spray paint can. As such, it is desirable to provide customers with the ability to view a large portion of the cap of the spray paint cans when selecting a desired color.

SUMMARY OF THE INVENTION

The present invention is a display rack for displaying and dispensing cylindrically-shaped products. The display rack includes a first storage region and a second storage region. The first storage region is capable of holding a plurality of cylindrically-shaped products. The first storage region has a first dispensing position. The first storage region is tilted towards the first dispensing position.

The second storage region surface is capable of holding a plurality of cylindrically-shaped products. The second storage region has a second dispensing position. The second storage region is adjacent to the first storage region. The second storage region is tilted towards the second dispensing position. The first storage region and the second storage region tilt away from each other.

DETAILED DESCRIPTION OF THE PREFERRED EMBODIMENTS

Figure 1:
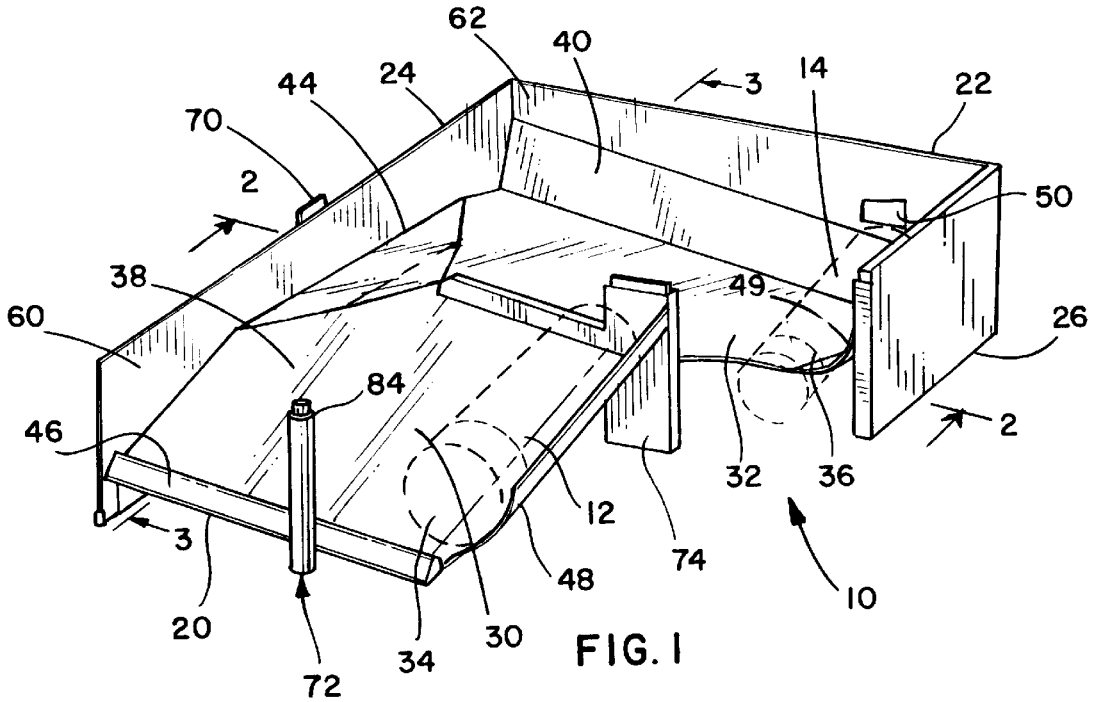
FIG. 1 is a perspective view of a display rack of the present invention.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

The present invention relates to a display rack, as most clearly illustrated at 10 in FIG. 1. The display rack 10 permits at least two cylindrically-shaped containers 12, 14 to be displayed. While the concepts of the present invention are particularly suited for use with cylindrically-shaped products, a person of ordinary skill in the art will appreciate that the display rack 10 of the present invention may also be used with products having other shapes.

The display rack 10 is suited for use in a retail store where it is desirable to provide potential purchasers with visual site of large numbers of different products that are packaged in cylindrically-shaped containers 12, 14. One such use that the display rack 10 of the present invention is particularly suited for is spray paint cans. The display rack 10 permits color-coded caps on the spray paint cans to be easily viewed by consumers.

The display rack 10 of the present invention stores a plurality of each of the at least two cylindrically-shaped containers 12, 14. The display rack 10 also maintains the containers 12, 14 in a faced orientation so that the containers 12, 14 can be easily dispensed from the display rack 10. The display rack 10 further provides a relatively large region for display of promotional materials that draw attention to, and encourage the purchase of the product in the containers 12, 14.

The display rack 10 has a generally rectangular configuration that is defined by a front edge 20, a back edge 22, a first side edge 24, and a second side edge 26. A person of ordinary skill in the art will appreciate that references to directions such as front and back are with respect to the orientation of the display rack 10 in its typical use orientation.

The display rack 10 includes a first storage region 30 and a second storage region 32, which is located adjacent to the first storage region 30. The first and second storage regions 30, 32 each preferably have a substantially planar surface. The first and second storage regions 30, 32 each include a display position 34, 36 and at least one storage position 38, 40 that is located adjacent to the respective display position 34, 36.

Figure 2:
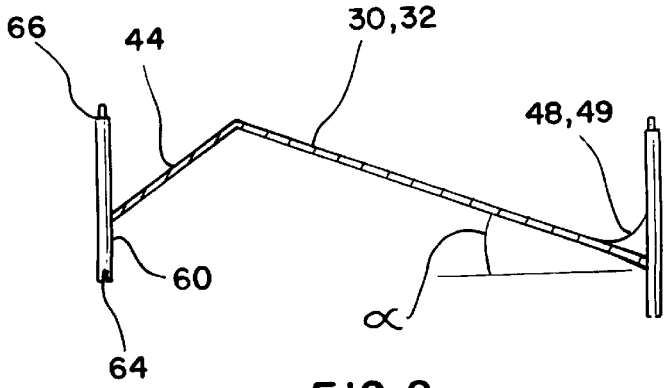
FIG. 2 is a sectional view of the display rack taken along a line 2—2 in FIG. 1.

The first and second storage regions 30, 32 are both oriented at a first angle a such that the display positions 34, 36 are lower than the storage positions 38, 40, as most clearly illustrated in FIG. 2. The first angle $\alpha$ is between about 3° and 40°, preferably between about 7° and 12°, and most preferably about 10°.

Figure 3:
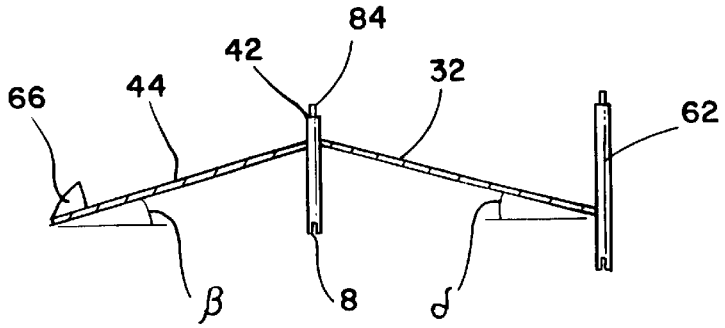
FIG. 3 is a sectional view of the display rack taken along a line 3—3 in FIG. 1.

The first storage region 30 and the second storage region 32 are tilted away from each other, as most clearly illustrated in FIG. 3. The first storage region 30 is oriented at a second angle $\beta$ with respect to a horizontal plane. The second storage region 32 is oriented at a third angle $\delta$ with respect to a horizontal plane.

While it is possible for the second angle β and the third angle δ to have different values, the second angle β and the third angle δ are preferably approximately equal to each other. The second angle β and the third angle δ are both between about 5° and 20°, preferably between about 12° and 15°, and most preferably between about 13° and 14°.

Proximate the intersection of the first storage region 30 and the second storage region 32, the display rack 10 preferably includes a ridge 42 extending from the surface thereof. The ridge 42 prevents containers 12, 14 from inadvertently moving between the first storage region 30 and the second storage region 32.

The display rack 10 also includes a loading surface 44 that extends between the first storage region 30 and the second storage region 32 intersection that is substantially adjacent to the ridge 42. The loading surface 44 permits containers 14 to be loaded into the second storage region 32 by sliding the container 14 along the surface of the first storage region 30. The loading surface 44 is preferably oriented at an angle s with respect to a horizontal plane. The angle ϵ is between 1° and 45°, preferably between 5° and 10°, and most preferably about 7°.

The loading surface 44 also facilitates placement of the container 14 into the second storage region 32 from the first storage region 30, without interference from a previous or subsequent container. Those skilled in the art will recognize that cans, such as aerosol cans often contain a rim along the bottom circumference of the side wall/bottom juncture. It has been observed that this rim can catch or lock with a can cap when the cans are engaged top-to-bottom with one another. The loading surface provides for misaligning the containers with one another during loading onto the second storage region 32. Thus the opportunity for cans to "catch" onto one another is greatly reduced or eliminated.

A lip 46 is provided along the front edge 20 to prevent the containers 12 placed in the first storage region 30 from sliding forwardly off the display rack 10. A height of the lip 46 is selected based upon the diameter of the container 12.

The first storage region 30 and the second storage region 32 each preferably include an upwardly directed surface 48, 49 that maintains the container 12, 14 at a desired location in the display position 34, 36. Preferably, the upwardly directed surface 48, 49 is curved to correspond with the curvature of the container 12, 14.

To enhance the ability to dispense containers 14 from the second storage region 32, the display rack preferably includes a guide or rail 50. The guide 50 extends inwardly of the second side edge 26 (toward the first side edge 24) and inwardly/forwardly of the back edge 22 toward the front edge 20, to thereby urge the container 14 partially out of the second storage region 32. A person of ordinary skill in the art will appreciate that the configuration of the guide 50 can be selected based upon the weight and size of the container 14 so that it is able to cause the desired movement of the container 14. Like the loading surface 44, the guide 50 further prevents the bottom rims of adjacent containers from catching onto one another which would otherwise interfere with removing the container 14 from the display rack 10.

To facilitate stacking of the display racks 10, the display rack 10 contains a first side wall 60 that extends along the first side edge 24 and a back wall 62 that extends along the back edge 22. A height of the first side wall 60 and the back 62 are selected based on a diameter of the containers 12, 14 that are to be used with the display rack 10. In particular, the height is sufficiently large such that the containers 12, 14 do not contact a display rack 10 that is above the containers 12, 14.

To retain the display racks 10 in a stacked configuration, the first side wall 60 and the back wall 62 each have an engagement mechanism 64 proximate to a lower edge thereof, as most clearly illustrated in FIGS. 2 and 3. The engagement mechanism 64 preferably includes a recess that is adapted to receive a complementary tab portion 66 that extends from an upper edge thereof.

To further enhance the ability to maintain the display racks 10 in a stacked configuration, a tab 70 preferably extends from the upper edge of the first side wall 60. The tab 70 is oriented to extend into a recess (not shown) formed in the lower edge of the first side wall 60.

The stability of the display rack stack is preferably further enhanced by a front vertical support member 72 and an intermediate vertical support member 74. The front and intermediate vertical support members 72, 74 each preferably have a height that is approximately the same as the height of the first side wall 60 and the back wall 62.

An engagement mechanism 80 is provided on both the front and intermediate vertical support members 72, 74. The engagement mechanism 80 preferably includes a recess 82 in a lower end of both the front and intermediate vertical support members 72, 74. The engagement mechanism 80 also includes an extension 84 that extends from both the front and intermediate vertical support members 72, 74. The extensions 84 extend into the corresponding recesses when the display racks 10 are stacked are thereby retain the adjacent front vertical support members 72 and the adjacent intermediate support members 74 in a fixed relationship with respect to each other.

To further enhance the commercial appeal of the display rack 10 of the present invention, the first side wall 60 and the back wall 62 preferably have information messages (not shown) printed thereon. The informational message may include guidance on the selection of a particular type of paint for a specified application and/or instructions on the use of the products.

Figure 4:
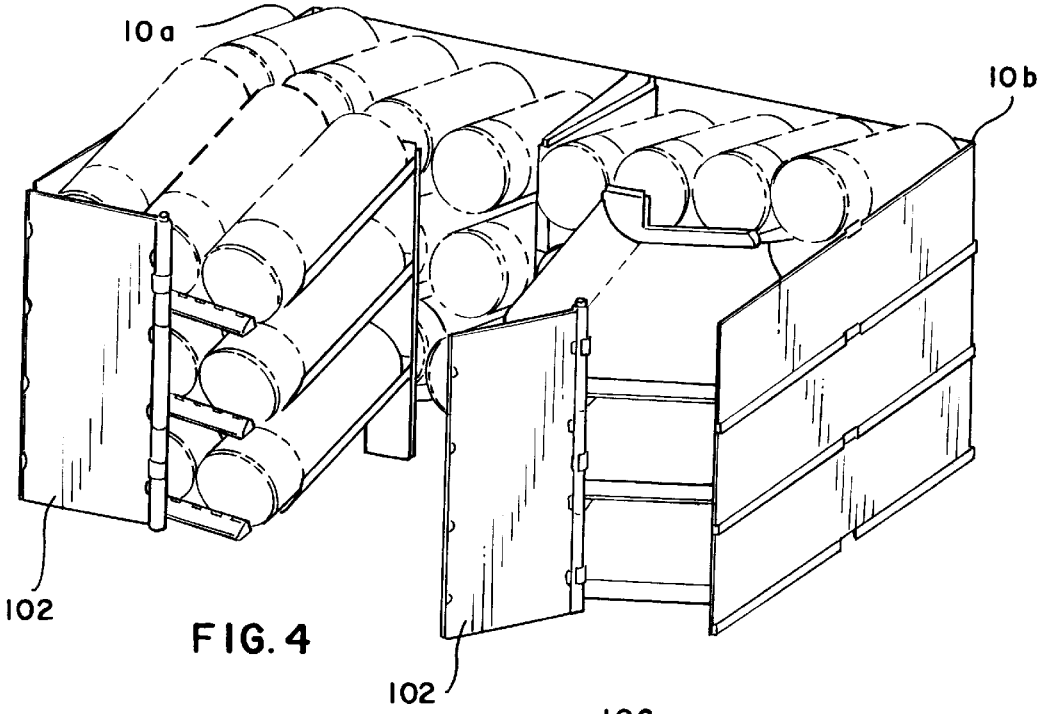
FIG. 4 is a perspective view of a product display system that incorporates a plurality of display racks.

The display rack 10 also preferably includes a pivotally mounted door 102 that substantially covers the containers 12, 14 that are not located in the first dispensing position 34, as most clearly illustrated in FIG. 4. The door 102 is preferably attached to the front vertical support member 72. Pivotally mounting the door 102 permits the door to be opened such that the display rack 10 can be restocked with containers 12, 14. The door 102 preferably includes an informational message relating to either the selection or use of the product contained in the containers 12, 14. Alternatively, the door can be hinged at other locations such as at the outer edge of the display racks 10, to pivot outwardly from the display racks 10.

The display racks 10 are preferably formed with a right configuration 10*a* and a left configuration 10*b*, as most clearly illustrated in FIG. 4. When the stacks of the display racks 10 are placed in an adjacent orientations, the stacks are preferably alternated so that a stack of left configuration display racks 10*a* are adjacent to a stack of right configuration display racks 10*b*. Such a configuration is particularly useful when the display racks 10 are positioned along a wall (not shown)

Figure 5:
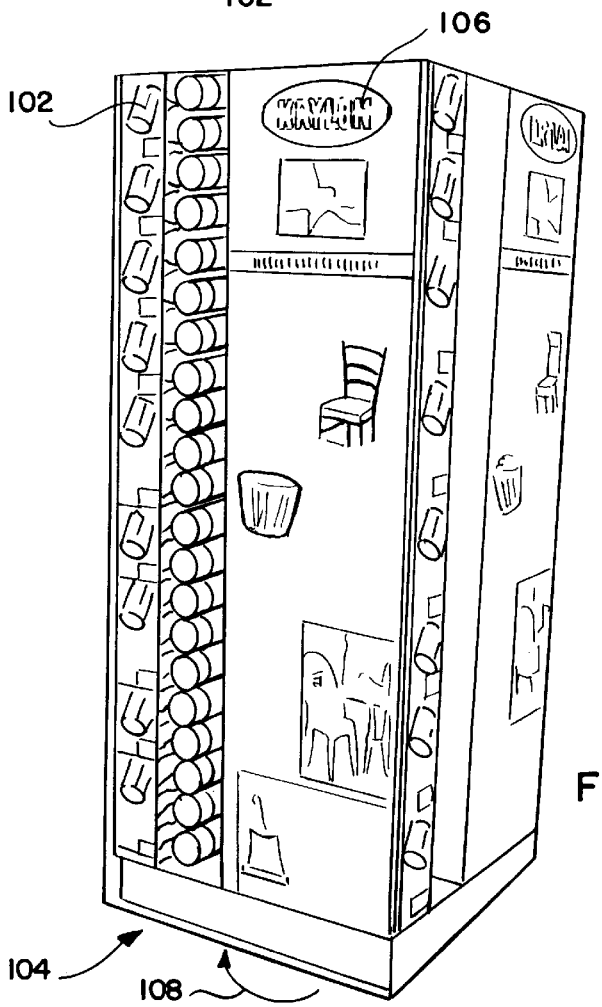
FIG. 5 is a perspective view of another product display system that incorporates a plurality of display racks.

Another configuration for the display rack 10 is on a self-standing tower 104, as is illustrated in FIG. 5. In this embodiment, the display racks are all preferably selected with either a right configuration or a left configuration. The door 102 and the first side wall 106 in this embodiment are preferably covered with information to assist on the selection or use of the product displayed in the self-standing tower 104. The self-standing tower 104 is preferably mounted for rotation about a central axis as indicated by arrow 108.

In operation, a second type of product 14 is moved along the first storage region 30 proximate the first side wall 60 so that the product 14 then slides over the loading surface 44 and into the second storage region 32. The angle a of the second storage region 32 causes the product 14 to slide into the second storage region 32 until a lower end of the product 14 contacts the back wall 62. The angle and orientation of the loading surface 44 prevents a first container 14 from "catching" a rim of a subsequent container. The product 14 then rolls towards the second dispensing position 36 and the product 14 contacts the upwardly directed surface 49. The guide 50 then biases the product 14 slightly away from the back wall 62.

The process is then repeated until a desired amount of the second type of product 14 is loaded on the second storage region 32 or the capacity of the second storage region 32 is met.

A first type of product 12 is then loaded into the first storage region 30 in a similar manner except that the first type of product 12 does not slide through the loading surface 44 or into the second storage region 32.

The front lip 46 prevents the product 12 from sliding off the first storage region 30 by movement towards the front of the display rack 12. However, the lip 46 is preferably sized so that containers can fit over the lip 46 onto the storage 38 or display 34 positions of the first storage region 30. The upward directed surface 48 prevents the product 12 from sliding off the first storage region 32 by movement towards a second side of the display rack 12.

When it is desired to dispense a product from the first storage region 30, the top portion of the product 12 that is in the dispensing position 34 is grasped and the product 12 is slid towards the front of the display rack 10. As soon as the product 12 is removed from the first storage region 30, the angle of the first storage region 30 causes another product 12 to roll into the dispensing position 34.

A similar procedure is used for dispensing product 14 from the second storage region 32.

From the foregoing, it will be observed that numerous modifications and variations can be effectuated without departing from the true spirit and scope of the normal concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A display rack for displaying and dispensing cylindrically-shaped products, the display rack comprising:

a first storage region that is capable of holding a first plurality of cylindrically-shaped products, wherein the first storage region has a first dispensing position, wherein the first storage region is tilted towards the first dispensing position;

a second storage region surface that is capable of holding a second plurality of cylindrically-shaped products, wherein the second storage region is adjacent to the first storage region, wherein the first storage region and the second storage region tilt away from each other; wherein the second storage region has a second dispensing portion, and wherein the second storage region is tilted towards the second dispensing position; and a loading surface extending between the first storage region and the second storage region.

2. The display rack of claim 1, wherein the first storage region and the second storage region are tilted towards the first dispensing position and the second dispensing position, respectively, at an angle of between about 3° and 40°.

3. The display rack of claim 1, wherein the first storage region and the second storage region are each tilted away from each other at an angle of between about 5° and 20°.

4. The display rack of claim 1, wherein the loading surface is oriented at an angle away from the first dispensing position.

5. The display rack of claim 1, and further comprising a ridge extending therefrom proximate an intersection of the first storage region and the second storage region.

6. A display rack for displaying and dispensing cylindrically-shaped products, the display rack comprising:

a first storage region that is capable of holding a first plurality of cylindrically-shaped products, wherein the first storage region has a first dispensing position, wherein the first storage region is tilted towards the first dispensing position;

a second storage region surface that is capable of holding a second plurality of cylindrically-shaped products, wherein the second storage region is adjacent to the first storage region, wherein the first storage region and the second storage region tilt away from each other, wherein the second storage region has a second dispensing portion, and wherein the second storage region is tilted towards the second dispensing position; and a guide that biases the second cylindrically-shaped containers at least partially out of the second storage region.

7. A display rack system for displaying and dispensing cylindrically-shaped products, the display rack system comprising a plurality of display racks, wherein each display rack comprises:

a first storage region that is capable of holding a first plurality of cylindrically-shaped products, wherein the first storage region has a first dispensing position, wherein the first storage region is tilted towards the first dispensing position;

a second storage region surface that is capable of holding a second plurality of cylindrically-shaped products, wherein the second storage region is adjacent to the first storage region, wherein the first storage region and the second storage region tilt away from each other, wherein the second storage region has a second dispensing position, wherein the second storage region is tilted towards the second dispensing position, and wherein the displayed racks are stacked in mating relationship; and a loading surface extending between the first storage region and the second storage region.

8. The display rack system of claim 7, wherein the first storage region and the second storage region are tilted towards the first dispensing position and the second dispensing position, respectively, at an angle of between about 3° and 40°.

9. The display rack system of claim 7, wherein the first storage region and the second storage region are each tilted away from each other at an angle of between about 5° and 20°.

10. The display rack system of claim 7, wherein the loading surface is oriented at an angle away from the dispensing portion.

11. A method of displaying cylindrical-shaped containers, the method comprising:

providing a display rack with a first storage region and a second storage region;

placing a first cylindrically-shaped container in the first storage region;

moving the first cylindrically-shaped container into a first dispensing region in the first storage region;

moving the first cylindrically-shaped container away from the second storage region;

placing a second cylindrically-shaped container in the second storage region;

moving the second cylindrically-shaped container into a second dispensing region of the second storage region; and moving the second cylindrically-shaped container away from the first storage region.

12. The method of claim 11, wherein the first storage region and the second storage region are both oriented at an angle such that the first dispensing position and the second dispensing position are lower than other portions of the first storage region and the second storage region.

13. The method of claim 11, wherein the first storage region and the second storage region are tilted away from each other.

14. The method of claim 11, wherein placing the second cylindrically-shaped container in the second storage region comprises moving the second cylindrically-shaped container through the first storage region and over a loading surface that extends between the first storage region and the second storage region.

15. The method of claim 14, wherein the loading surface is tilted away from the first dispensing position and the second dispensing position.

16. The method of claim 11, and further comprising biasing the second cylindrically-shaped container partially out of the second storage region.

17. The method of claim 11, and further comprising stacking at least two display racks in a mating relationship.

18. The method of claim 17, and further comprising removably covering at least a portion of the first storage region that is adjacent the first dispensing position with an advertising or instructional message.

* * * * *